US011759695B1

(12) United States Patent
Newman

(10) Patent No.: US 11,759,695 B1
(45) Date of Patent: Sep. 19, 2023

(54) APPARATUS FOR CARRYING MULTIPLE SETS OF SKIS

(71) Applicant: Aaron Newman, Denver, CO (US)

(72) Inventor: Aaron Newman, Denver, CO (US)

( * ) Notice: Subject to any disclaimer, the term of this patent is extended or adjusted under 35 U.S.C. 154(b) by 0 days.

(21) Appl. No.: 18/124,731

(22) Filed: Mar. 22, 2023

(51) Int. Cl.
*A63C 11/02* (2006.01)
*A45F 3/14* (2006.01)

(52) U.S. Cl.
CPC ..... *A63C 11/025* (2013.01); *A45F 3/14* (2013.01); *A45F 2003/142* (2013.01); *Y10S 224/917* (2013.01)

(58) Field of Classification Search
CPC . Y10S 224/917; A63C 11/021; A63C 11/023; A63C 11/025; A45F 3/14; A45F 2003/142
USPC ..... 294/147
See application file for complete search history.

(56) References Cited

U.S. PATENT DOCUMENTS 4,002,277 A * 1/1977 Westerholm ..... A63C 11/025 294/154
4,470,528 A * 9/1984 Dyess ..... A63C 11/025 294/147
4,852,931 A * 8/1989 Ferdi ..... A63C 11/025 294/147
4,856,689 A * 8/1989 Shore ..... A63C 11/025 224/264
4,863,083 A * 9/1989 Chen ..... A63C 11/025 224/663
5,575,412 A * 11/1996 Arias ..... A63C 11/025 224/257
6,457,762 B1 * 10/2002 Garutti ..... A63C 11/006 294/149
8,616,600 B2 * 12/2013 Owen ..... A63C 11/021 294/154

* cited by examiner

*Primary Examiner* — Dean J Kramer
(74) *Attorney, Agent, or Firm* — Hall Estill Law Firm; Bryan A. Fuller

(57) ABSTRACT

A ski carrying apparatus that includes a first strap securable around a set of primary skis and a second strap securable around a first set of secondary skis. The ski carrying apparatus can also include a linkage assembly that connects the first strap to the second strap that permits the second strap to be positioned substantially perpendicular to the first strap when the ski carrying apparatus is in use. Another embodiment of a ski carrying apparatus for supporting sets of secondary skis. The ski carrying apparatus includes a first strap securable around a first set of secondary skis and a second strap securable around a second set of secondary skis. The ski carrying apparatus can also include a handle that can be removably attached to the first or second strap for carrying the two sets of secondary skis.

20 Claims, 5 Drawing Sheets

APPARATUS FOR CARRYING MULTIPLE SETS OF SKIS

STATEMENT REGARDING FEDERALLY SPONSORED RESEARCH OR DEVELOPMENT

Not applicable.

CROSS-REFERENCE TO RELATED APPLICATIONS

Not Applicable.

BACKGROUND OF THE DISCLOSURE

1. Field of the Invention

The present disclosure relates to an apparatus for carrying multiple sets of snow skis.

2. Description of the Related Art

Snow skis can be challenging to carry, especially when carrying ski boots as well. When going snow skiing, a person can find themselves having to carry sets of snow skis in addition to their own skis. Typically, this happens to parents who are having to carry multiple sets of their children's skis. There are different types of ski carriers out there, but they are typically designed to carry a single set of skis.

Accordingly, there is a need for an apparatus that allows for a person to carry additional sets of snow skis beyond their own set of skis.

SUMMARY OF THE DISCLOSURE

The present disclosure is directed to a ski carrying apparatus. The ski carrying apparatus includes a first strap securable around a set of primary skis and a second strap securable around a first set of secondary skis. The ski carrying apparatus can also include a linkage assembly that connects the first strap to the second strap that permits the second strap to be positioned substantially perpendicular to the first strap when the ski carrying apparatus is in use.

The present disclosure is also directed to another embodiment of a ski carrying apparatus for supporting sets of secondary skis. The ski carrying apparatus includes a first strap securable around a first set of secondary skis and a second strap securable around a second set of secondary skis. The ski carrying apparatus can also include a handle that can be removably attached to the first or second strap for carrying the two sets of secondary skis.

DETAILED DESCRIPTION OF THE DISCLOSURE

Figure 1:
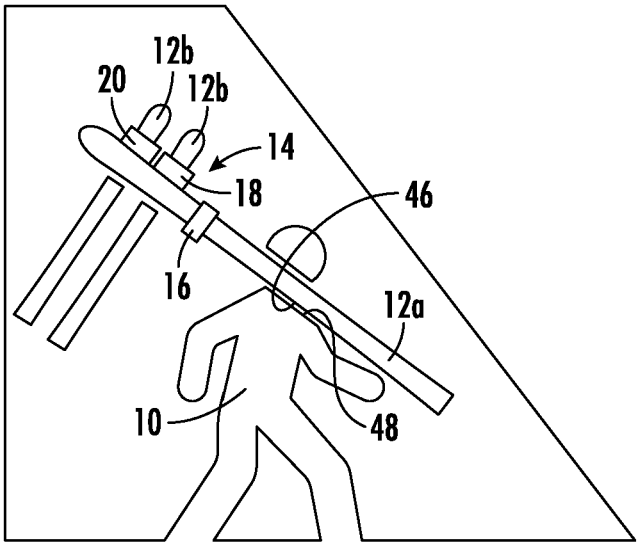
FIG. 1 is a side elevation view of a ski carrying apparatus implemented by a skier constructed in accordance with the present disclosure.

Referring now to FIG. 1, shown therein is a person 10 carrying multiple skis 12 using a ski carrying apparatus 14. The ski carrying apparatus 14 is used by a person to carry multiple sets of skis 12. The ski carrying apparatus 14 allows a person 10 to use a set of primary skis 12*a* to carry at least one set of secondary skis 12*b*. The person 10 can carry the primary skis 12*a* over their shoulder wherein a part of the primary skis 12*a* extends behind the person 10. Using the ski carrying apparatus 14, the secondary skis 12*b* can hang substantially vertically from them mostly horizontally disposed primary skis 12*a* when primary skis 12*a* are carried this way.

Figure 2:
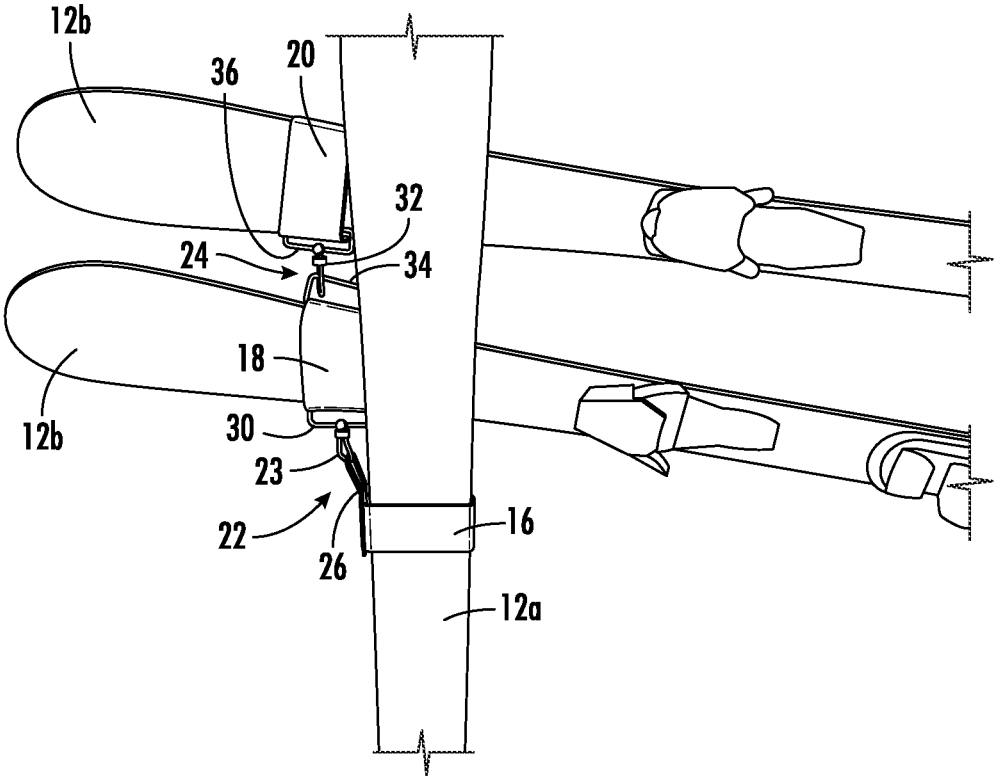
FIG. 2 is a perspective view of the ski carrying apparatus constructed in accordance with the present disclosure.
Figure 3A:
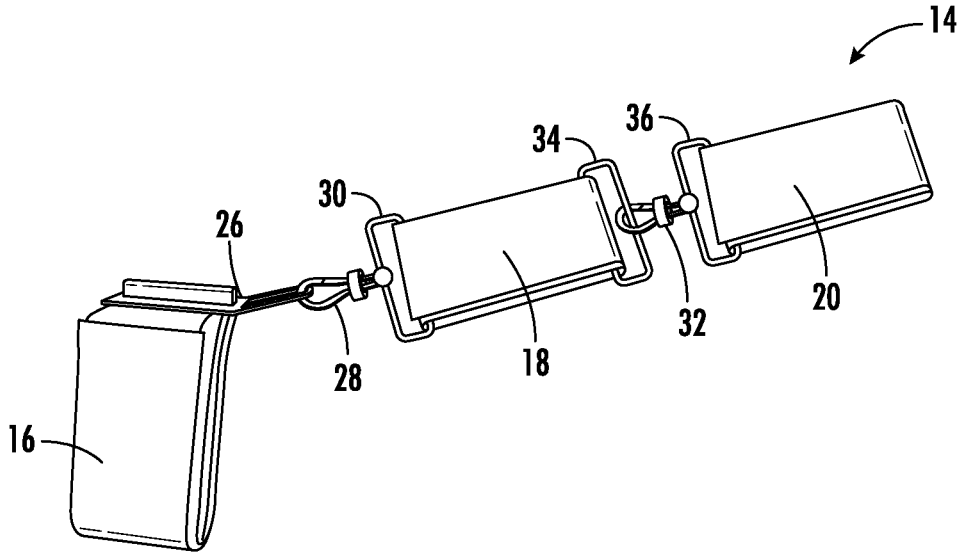
FIG. 3A is a side elevation view of the ski carrying apparatus in a closed position constructed in accordance with the present disclosure.
Figure 3B:
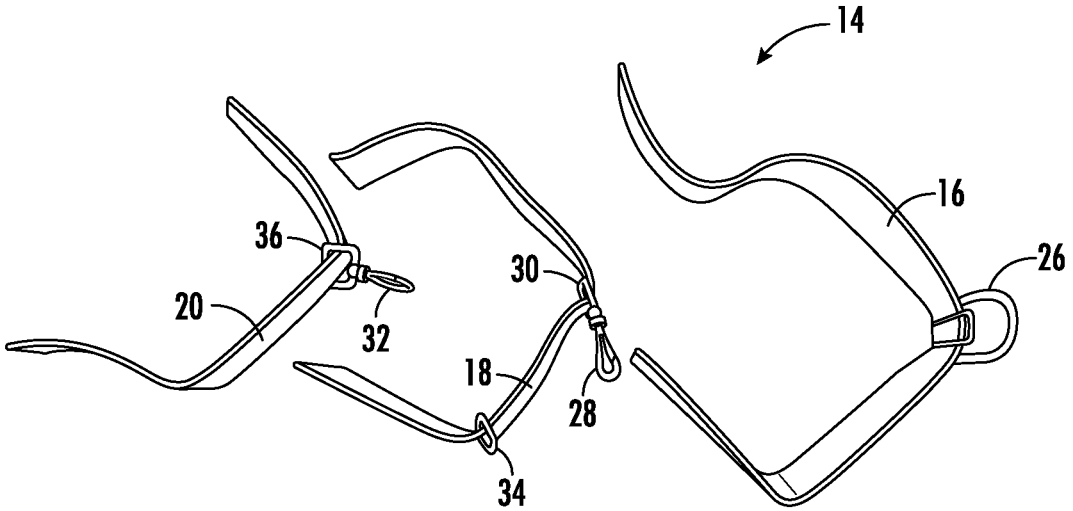
FIG. 3B is a side elevation view of the ski carrying apparatus in an open position constructed in accordance with the present disclosure.

In one embodiment shown in FIGS. 2-3B, the ski carrying apparatus 14 includes a primary strap 16 for being secured around the primary skis 12*a*, a secondary strap 18 for being secured around a first set of secondary skis 12*b* and a tertiary strap 20 for being secured around a second set of secondary skis 12*b*. The straps 16, 18 and 20 are designed to prevent the separation of the pair of skis they are strapped around. Each strap 16, 18 and 20 can be secured to itself via a securing feature. The securing feature can be any mechanism known in the art securable to each strap 16, 18 and 20 capable of securing each strap to itself around the desired set of skis, such as hooks and loops (i.e., Velcro®), buttons, etc. The straps 16, 18 and 20 can be constructed of any material such that the material can withstand the stresses and strains they are subjected to.

The ski carrying apparatus 14 can also include a first linkage assembly 22 for connecting the primary strap 16 to the secondary strap 18 and a second linkage assembly 24 for connecting the secondary strap 18 to the tertiary strap 20. In an alternative embodiment shown in FIGS. 6A-6B, the second linkage assembly 24 can connect the primary strap 16 to the tertiary strap 20. The linkage assemblies 22 or 24 can be any type of device or combination of devices that connects the desired straps. For example, the linkage assemblies 22 and 24 can include couplers, fasteners, adapters, buckles, clips, hooks, swivel buckle hoods, quick release buckles, tactical buckles, g hooks, and the like. Certain parts of the linkage assemblies 22 and 24 can be built into the straps as well, or be only straps. Furthermore, the linkage assemblies 22 or 24 can be any size, length, shape, etc. such that the secondary strap 18 and the tertiary strap 20 can be positioned on the secondary skis 12*b* in any desired location. Depending on the orientation of the ski carrying apparatus 14, the linkage assembly 22 can include a ring member 26 secured to the primary strap 16, a clip device 28 for selective attachment to the ring member 26 secured to the primary strap 16 and a second ring member 30 secured to the secondary strap 18. In a further embodiment, the second linkage assembly 24 can include a second clip device 32 that is releasably connectable to a third ring member 34 supported or attached to the secondary strap 18 and connectable to a fourth ring member 36 supported or attached to the tertiary strap 20.

Figure 5:
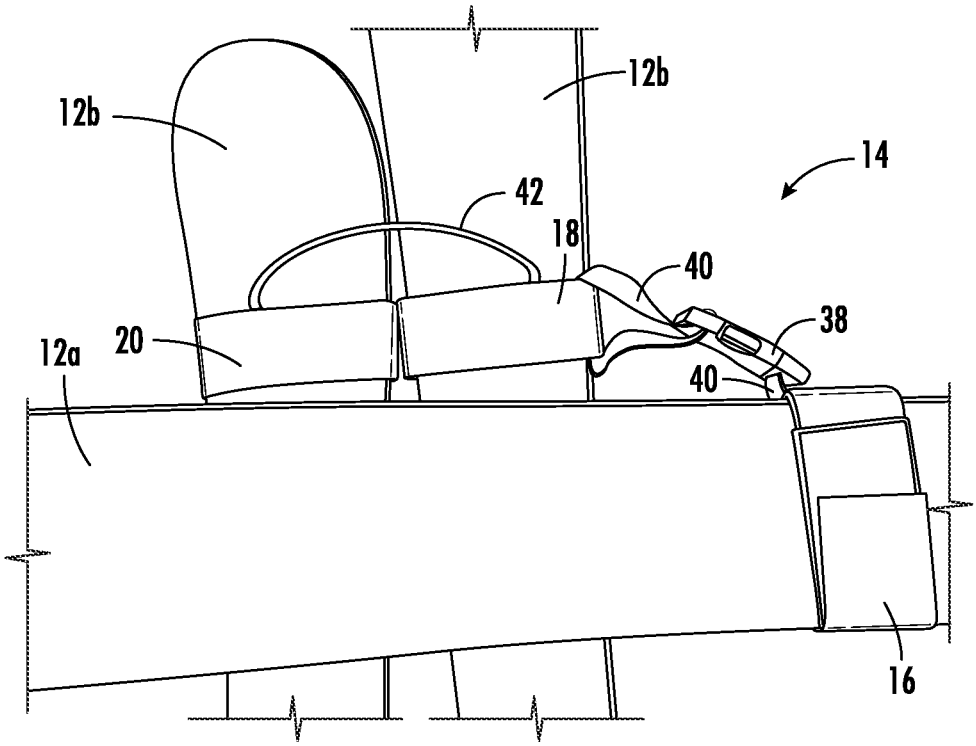
FIG. 5 is a perspective view of another embodiment of a ski carrying apparatus constructed in accordance with the present disclosure.

The clip devices 28 and 32 can be any type of clip device known that can be attached to multiple ring members such as a carabiner clip. In one embodiment, the clip devices 28 and 32 are rotatably connected to the second and third or fourth ring members 30 and 34 or 36, respectively. In another embodiment, the clip devices 28 and 32 of the linkage assemblies 22 and 24 could be replaced with a buckle 38 as shown in FIG. 5. The ring members 26, 30, 34 and 36 can be supported by or attached to the appropriate strap 16, 18 or 20. The ring members 26, 30, 34 and 36 can be constructed of any material such that they can withstand the forces applied and function as designed, such as a metallic, polymeric or cloth material. The ring members 26, 30, 34 and 36 can also have any shape desirable such that the desired functionality of the ski carrying apparatus 14 is maintained. For example, the ring members 26, 30, 34 and 36 can be circular, triangular, square, rectangular, polygonal, and the like. In one embodiment, the strap 16, 18 or 20 can be threaded through a portion of the ring members 26, 30, 34 or 36 to support and secure the desired ring member to the appropriate strap. If the ring member 26, 30, 34 or 36 is constructed of a cloth material, the ring member 26, 30, 34 or 36 could be sewn into the strap. The clip devices 28 and 32 and the buckle 38 allow for the linkage assemblies 22 or 24 to be disconnected and the desired straps to be separated from each other.

Figure 4:
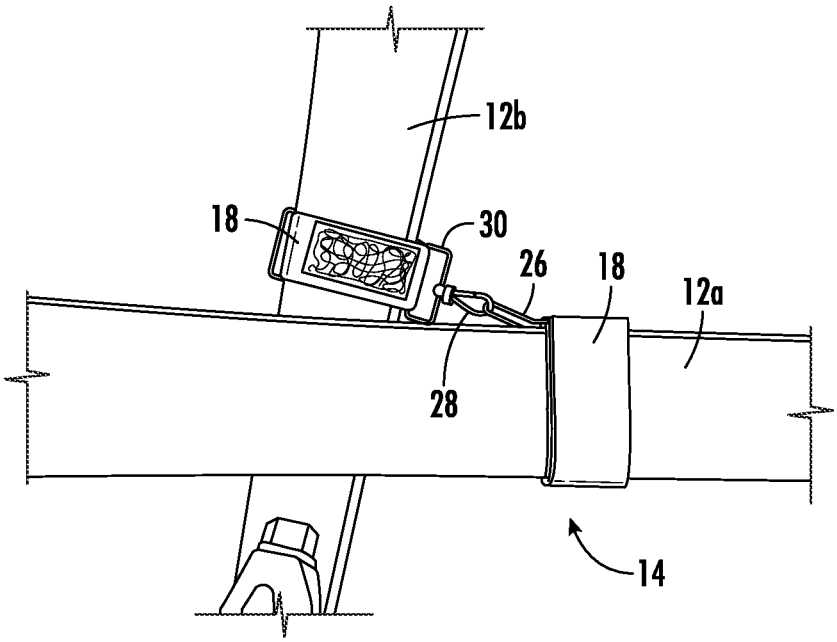
FIG. 4 is a perspective view of another embodiment of a ski carrying apparatus constructed in accordance with the present disclosure.

FIG. 4 shows an embodiment where only one set of secondary skis 12*b* are being supported by the primary skis 12*a*. In this embodiment, the ski carrying apparatus 14 includes only the primary strap 16 for strapping around the primary skis 12*a*, the secondary strap 18 for being strapped around the secondary skis 12*b* and the first linkage assembly 22 for connecting the primary strap 16 to the secondary strap 18.

In another embodiment of the present disclosure, the secondary strap 18 and the tertiary strap 20 are directly connected and the ski carrying apparatus 14 only includes the first linkage assembly 22 to attach the primary strap 16 to the connected secondary strap 18 and tertiary strap 20. As mentioned above, the embodiment shown in FIG. 5 includes the buckle 38 as part of the first linkage assembly 22. The linkage assembly 22 can include straps of material 40 threaded through ends of the buckle 38 that attach to the primary strap 16 and the connected secondary strap 18 and tertiary strap 20. A handle 42 can be added to the connected secondary strap 18 and the tertiary strap 20 to provide a mechanism to carry the strapped up secondary skis 12*b* to be supported by the primary skis 12*a*. The strap 42 can be removable from the secondary and tertiary straps 18 and 20.

In a further embodiment, the ski carrying apparatus 14 can include the secondary strap 18 and the tertiary strap 20 secured around secondary skis 12*b* wherein the secondary strap 18 and the tertiary strap 20 are attached to each other. The ski carrying apparatus 14 in this embodiment can include the handle 42 that is selectively removable from the secondary strap 18 and/or the tertiary strap 20. The handle 42 can be used to carry the secondary skis 12*b*, or to place the two strapped secondary skis 12*b* between the primary skis 12*a* that has the primary strap 16 attached thereto to keep the primary skis 12*a* from separating. In another embodiment, the handle 42 can be two separate pieces that can be attached to create the handle 42. One of the pieces of the handle 42 can be attached to the secondary strap 18 and the other piece of the handle 42 can be attached to the tertiary strap.

Figure 6A:
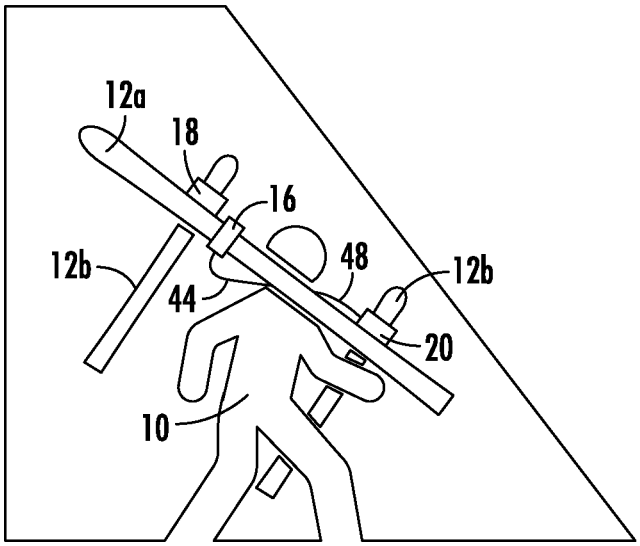
FIG. 6A is a side elevation view of another embodiment of a ski carrying apparatus implemented by a skier constructed in accordance with the present disclosure.
Figure 6B:
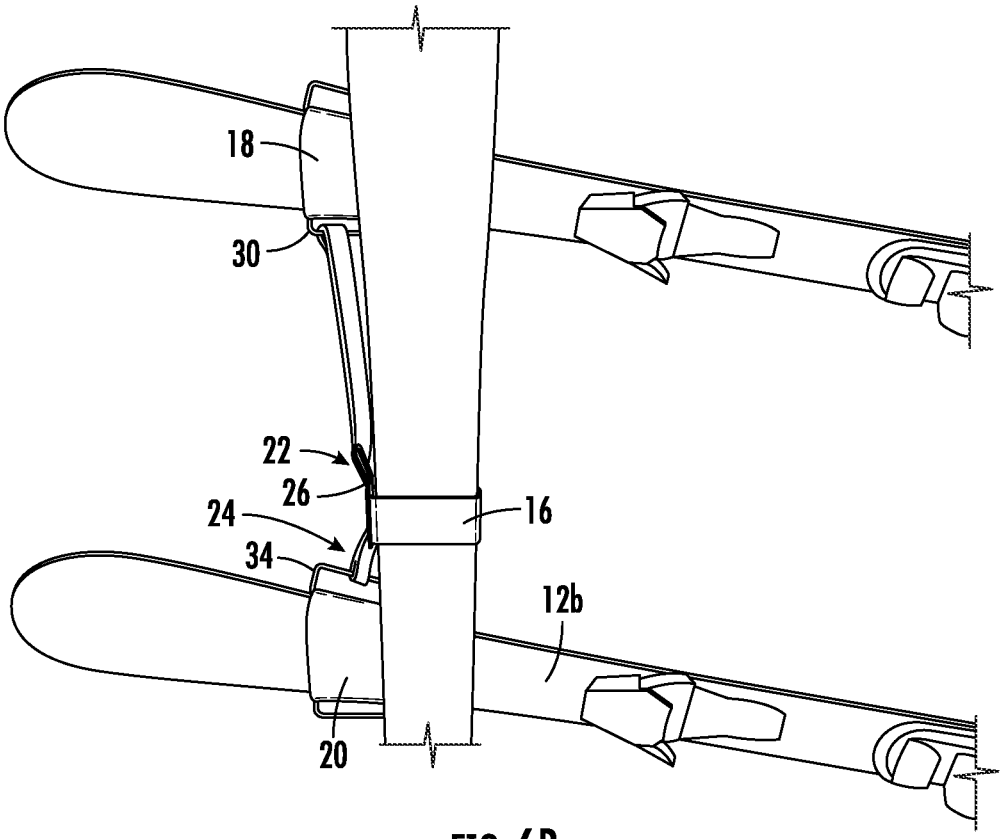
FIG. 6B is a side elevation view of the ski carrying apparatus shown in FIG. 6A constructed in accordance with the present disclosure.

In yet another embodiment of the present disclosure shown in FIGS. 6A and 6B, the second linkage assembly 24 can extend from the primary strap 16 to the tertiary strap 20 or from the secondary strap 18 to the tertiary strap 20. The second linkage assembly 24 can include a flexible extension member 44 to maintain connectivity of the ski carrying apparatus 14 and allow the tertiary strap 20, and thus one set of the secondary skis 12*b*, to be positioned in front of the person 10 carrying the primary skis 12*a* the secondary skis 12*b* are supported by. The flexible extension member 44 can be built into one of the strips of material 40 discussed from FIG. 5, or it could be built into the second or third ring member 32 or 34 associated with the secondary strap 18. In another embodiment, the flexible extension member 44 can have a clip (not shown) that permits the extension member 44 to be used when desired or removed when the ski carrying apparatus 14 is to be used in a different orientation. When the clip is used on the flexible extension member 44, the clip could attach to the fourth ring member 36 of the tertiary strap 20 and the other end of the flexible extension member 44 can include a loop to attach to the second clip device 32 of the second linkage assembly 24.

In use, the primary strap 16 can be secured around the primary skis 12*a* to secure the primary skis 12*a* together and the secondary strap 18 can be secured around a first set of secondary skis 12*b*. Skis are flexible therefore, each of the primary skis 12*a* can be separated a little bit even when the primary strap 16 is secured around a part of the primary skis 12*a*. The flexion of the primary skis 12*a* and the little bit of separation permitted allows the first set of secondary skis 12*b* to be slid between the primary skis 12*a*. The first set of secondary skis 12*b* are placed such that the secondary strap 18 is positioned adjacent to the side 46 of the primary skis 12*a* when the primary skis 12*a* are carried over the shoulder 48 of the person 10 carrying the primary skis 12*a*. The first set of secondary skis 12*b* can be forced as close to the primary strap 16 as can be so that the primary skis 12*a* squeeze the first set of secondary skis 12*b*. The first linkage assembly 22 is used to connect the secondary strap 18 to the primary strap 16. Similarly, the second set of secondary skis 12*b* can be positioned between the set of primary skis 12*a* adjacent to the first set of secondary skis 12*b*. The second linkage assembly 24 can then be used to connect the tertiary strap 20 to the secondary strap.

Figure 7:
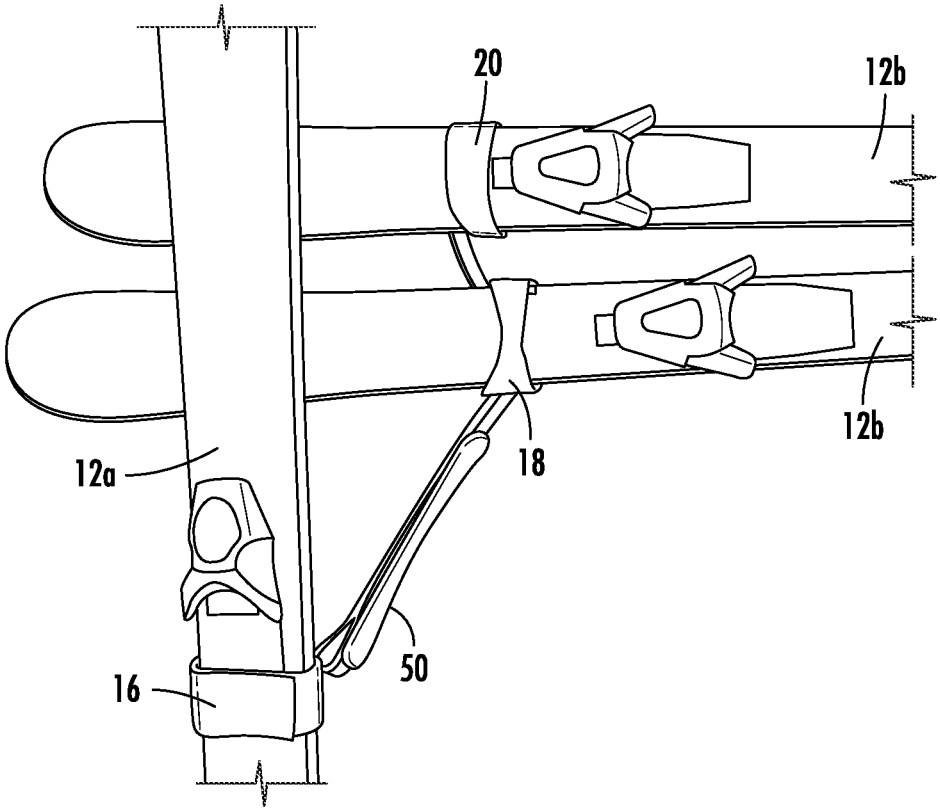
FIG. 7 is a perspective view of another embodiment of the ski carrying apparatus constructed in accordance with the present disclosure.

Referring now to FIG. 7, shown therein is another embodiment of the ski carrying apparatus 14. In this embodiment, the ski carrying apparatus 14 can include a padded member 50 that can be included with the first or second linkage assemblies 22 or 24 such that the person 10 carrying the skis 12 can position the padded member 50 between the primary skis 12*a* and the person's shoulder 48. The padded member 50 can be secured to the linkage assemblies 22 or 24 in any manner known in the art. The padded member 50 can be tethered to the one of the linkage assemblies 22 or 24 or the padded member could be implemented into a sleeve that surrounds a portion of one of the linkage assemblies 22 or 24.

From the above description, it is clear that the present disclosure is well-adapted to carry out the objectives and to attain the advantages mentioned herein as well as those inherent in the disclosure. While presently preferred embodiments have been described herein, it will be understood that numerous changes may be made which will readily suggest themselves to those skilled in the art and which are accomplished within the spirit of the disclosure and claims.

What is claimed is:

1. A ski carrying apparatus, the ski carrying apparatus comprising:

a first strap securable around a set of primary skis;

a second strap securable around a first set of secondary skis;

a first linkage assembly that connects the first strap to the second strap that permits the second strap to be positioned substantially perpendicular to the first strap when the ski carrying apparatus is in use, the first linkage assembly includes a first ring member that engages with the first strap and a second ring member that engages with the second strap; and a third strap securable around a second set of secondary skis and a second linkage assembly that connects the third strap to the second strap that permits the third strap to be positioned substantially perpendicular to the first strap and substantially parallel to the second strap when the ski carrying apparatus is in use.

2. The ski carrying apparatus of claim 1 wherein the second linkage assembly includes a third ring member that engages with the second strap.

3. The ski carrying apparatus of claim 2 wherein the second linkage assembly further includes a fourth ring member that engages with the third strap.

4. The ski carrying apparatus of claim 3 wherein the first linkage assembly includes a first clip for attachment to the first ring member and the second ring member to secure the second strap to the first strap.

5. The ski carrying apparatus of claim 4 wherein the second linkage assembly includes a second clip for attachment to the third ring member and the fourth ring member to secure the third strap to the second strap.

6. The ski carrying apparatus of claim 5 wherein the second clip is rotatably attached to the third or fourth ring member.

7. The ski carrying apparatus of claim 4 wherein the first clip is rotatably attached to the second ring member.

8. The ski carrying apparatus of claim 4 wherein the second linkage assembly includes a second buckle for attachment to the third ring member and the fourth ring member to secure the third strap to the second strap.

9. The ski carrying apparatus of claim 3 wherein the first linkage assembly includes a first buckle for attachment to the first ring member and the second ring member to secure the second strap to the first strap.

10. The ski carrying apparatus of claim 1 wherein the second linkage assembly further comprises a flexible extension member to permit one of the first or second set of secondary skis to be carried in front of a person using the ski carrying apparatus.

11. The ski carrying apparatus of claim 1 wherein each of the first, second and third straps are securable to themselves.

12. The ski carrying apparatus of claim 1 further comprising a padded element that can be placed between a shoulder of a person carrying the primary skis and the primary skis.

13. The ski carrying apparatus of claim 12 wherein the padded element is connected to the first or second linkage assembly.

14. The ski carrying apparatus of claim 1 further comprising a handle that can be removably attached to the second strap or third strap for carrying the two sets of secondary skis.

15. A ski carrying apparatus, the ski carrying apparatus comprising:

a first strap securable around a set of primary skis;

a second strap securable around a first set of secondary skis;

a first linkage assembly that connects the first strap to the second strap that permits the second strap to be positioned substantially perpendicular to the first strap when the ski carrying apparatus is in use; and a third strap securable around a second set of secondary skis and attached directly to the second strap that permits the third strap to be positioned substantially perpendicular to the first strap and substantially parallel to the second strap when the ski carrying apparatus is in use.

16. The ski carrying apparatus of claim 15 further comprising a handle that extends from the second strap to the third strap.

17. The ski carrying apparatus of claim 15 wherein the first linkage assembly includes a first ring member that engages with the first strap and a second ring member that engages with the second strap.

18. The ski carrying apparatus of claim 17 wherein the first linkage assembly includes a first clip for attachment to the first ring member and the second ring member to secure the second strap to the first strap.

19. The ski carrying apparatus of claim 18 wherein the first clip is rotatably attached to the second ring member.

20. The ski carrying apparatus of claim 17 wherein the first linkage assembly includes a first buckle for attachment to the first ring member and the second ring member to secure the second strap to the first strap.

* * * * *